US006459091B1

(12) United States Patent
DeMeo et al.

(10) Patent No.: US 6,459,091 B1
(45) Date of Patent: Oct. 1, 2002

(54) LIGHTWEIGHT RADIATION PROTECTIVE GARMENTS

(75) Inventors: Ronald DeMeo, Miami; Marcus D. Benedetto, North Miami Beach, both of FL (US)

(73) Assignee: Meridian Research and Development, Miami Beach, FL (US)

( * ) Notice: Subject to any disclaimer, the term of this patent is extended or adjusted under 35 U.S.C. 154(b) by 0 days.

(21) Appl. No.: 09/940,681

(22) Filed: Aug. 27, 2001

Related U.S. Application Data

(63) Continuation-in-part of application No. 09/206,671, filed on Dec. 7, 1998, now Pat. No. 6,281,515.

(51) Int. Cl.[7] ..... B21F 3/02
(52) U.S. Cl. ..... 250/516.1
(58) Field of Search ..... 250/516.01, 515.1, 250/519; 525/328.6

(56) References Cited

U.S. PATENT DOCUMENTS

| | | | | |
|---|---|---|---|---|
| 1,800,051 | A | | 4/1931 | Blanco |
| 3,030,628 | A | | 4/1962 | Crosson |
| 3,045,121 | A | | 7/1962 | Leguillon |
| 3,052,799 | A | | 9/1962 | Hollands |
| 3,164,840 | A | | 1/1965 | Reynolds |
| 3,569,713 | A | | 3/1971 | Via, Jr. |
| 3,883,749 | A | | 5/1975 | Whittaker et al. |
| 3,974,104 | A | | 8/1976 | Foster et al. |
| 4,103,176 | A | * | 7/1978 | Coyle ..... 378/204 |
| 4,129,524 | A | | 12/1978 | Nagai et al. |
| 4,429,094 | A | | 1/1984 | Massucco |
| 4,589,408 | A | | 5/1986 | Singer |
| 4,740,526 | A | | 4/1988 | Yamamoto |
| 4,882,392 | A | * | 11/1989 | Smid et al. ..... 523/117 |
| 4,913,978 | A | | 4/1990 | Klotz et al. |
| 4,938,233 | A | | 7/1990 | Orrison, Jr. |
| 5,001,354 | A | | 3/1991 | Gould et al. |
| 5,016,292 | A | | 5/1991 | Rademacher |
| 5,038,047 | A | | 8/1991 | Still |
| 5,140,710 | A | | 8/1992 | Rademacher |
| 5,245,195 | A | | 9/1993 | Shah et al. |
| 5,446,925 | A | | 9/1995 | Baker et al. |
| 5,453,314 | A | | 9/1995 | Collier et al. |
| 5,506,059 | A | * | 4/1996 | Robbins et al. ..... 428/201 |
| 5,523,581 | A | | 6/1996 | Cadwalader et al. |
| 5,525,408 | A | | 6/1996 | Weir et al. |
| 5,637,113 | A | * | 6/1997 | Tartaglia et al. ..... 604/104 |
| 5,660,892 | A | * | 8/1997 | Robbins et al. ..... 427/123 |
| 5,856,415 | A | | 1/1999 | Lagace et al. |
| 6,281,515 | B1 | | 8/2001 | Demeo et al. |

OTHER PUBLICATIONS

SU 1424847A Gorelashvi, G.P; Kuus E.M; Talvari, A.A.*

* cited by examiner

*Primary Examiner*—Jack Berman
*Assistant Examiner*—Johnnie L Smith, II
(74) *Attorney, Agent, or Firm*—Townsend and Townsend and Crew LLP; Guy W. Chambers

(57) ABSTRACT

A lightweight, breathable material which has radiopaque qualities and a method for making the radiopaque material. In a preferred embodiment, a lightweight fabric, such as a cloth surgical mask liner (24) or an entire surgical mask (10), is impregnated with a lightweight radiopaque compound, such as a barium sulfate compound, to impart radiopaque qualities. Impregnation of the lightweight radiopaque compound can be performed in any number of ways, including soaking the fabric in a solution containing the lightweight radiopaque compound, using the fabric as a filter in a passing solution of the lightweight radiopaque compound, placing the fabric in a reaction chamber between reagent solutions whose interaction will form the lightweight radiopaque compound and impregnating the fabric with one reagent and then exposing it to a complementary reagent whose reaction with the first reagent will form a lightweight radiopaque compound. To enhance the efficiency of impregnation, an additive, such as a Gum Arabic or Guar Gum adhesive, can be added to the solution containing lightweight radiopaque compound or to the fabric itself. While a surgical mask is provided as one example, the principles of the invention can also be applied to a broad range of other items including surgical hoods, hospital gowns, gloves, partitions, patient drapes, coverings etc.

23 Claims, 2 Drawing Sheets

LIGHTWEIGHT RADIATION PROTECTIVE GARMENTS

CROSS-REFERENCES TO RELATED APPLICATIONS

This application is a continuation-in-part of application Ser. No. 09/206,671, filed Dec. 7, 1998, also entitled "Lightweight Radiation Protective Garments," which is now U.S. Pat. No. 6,281,515, issued Aug. 28, 2001.

BACKGROUND OF THE INVENTION

The present invention relates primarily to garments which can protect the wearer against the hazards of exposure to radiation. More particularly, the present invention relates to breathable, lightweight garments containing radiopaque compounds, such as barium sulfate, that are particularly suitable for use by medical professionals and patients who are exposed to radiation from medical x-rays.

It is very common in medicine today to use x-rays for diagnostic and therapeutic purposes. While these x-rays serve a beneficial medical purpose, they can also have harmful side effects for both the patient to whom the x-rays are directed and the medical workers who must administer x-rays on a day-to-day basis.

There have been a number of previous attempts to mitigate the harmful effects of x-rays through the design of radiopaque protective garments. Typically, these radiopaque garments consist of a stiff material, such as rubber, impregnated by lead or some other heavy metal which is capable of blocking x-rays. Examples of lead impregnated radiopaque garments can be found in Holland's U.S. Pat. No. 3,052,799, Whittaker's U.S. Pat. No. 3,883,749, Leguillon's U.S. Pat. No. 3,045,121, Via's U.S. Pat. No. 3,569,713 and Still's U.S. Pat. No. 5,038,047.

While the lead filled prior art garments provide a good measure of protection against the harmful effects of x-rays, these prior art garments are often heavy, stiff, expensive, bulky and lacking in breathability. As such, these garments are often uncomfortable, cumbersome and restrictive. Also, there are sterility issues with these prior art garments because they are typically too bulky and expensive to dispose of after each use.

BRIEF SUMMARY OF THE INVENTION

The present invention provides a breathable, lightweight material which has radiopaque qualities and is easy to produce. In the preferred embodiment, a lightweight fabric, such as a cloth surgical mask liner or an entire surgical mask, is impregnated with a lightweight radiopaque compound, such as barium sulfate, to impart radiopaque qualities.

Impregnation of the lightweight radiopaque compound can be performed in any number of ways, including soaking or dipping the fabric in a solution containing the lightweight radiopaque compound, using the fabric as a filter for a passing solution containing the lightweight radiopaque compound, placing the fabric in a reaction chamber between reagents that can react to form the lightweight radiopaque compound and creating the fabric incorporating one radiopaque compound reagent and then exposing it to a complementary reagent used to form the radiopaque compound. To improve the efficiency of impregnation, an adhesive, such as Gum Arabic or Guar Gum, can be added to either the fabric or the solution of lightweight radiopaque compound during the impregnation process.

Besides barium sulfate, other radiopaque substances which can be used for the present invention include, but are not limited to, HYPAQUE™ (which is a tradename of Nycomed Corporation for Diatrizoate Meglumine Inj USP), Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

In alternative embodiments, radiopaque qualities can be imparted to garments by using a light sheet of radiopaque liner, such as aluminum, or weaving radiopaque metal or metallized threads into the garment. While a surgical mask is provided as one example, the principles of the invention can also be applied to a broad range of other garments including surgical hoods, hospital gowns, gloves, patient drapes, partitions, coverings, etc. In addition, other items, such as an impregnated eye shield, can be attached to or incorporated within the radiopaque garments of the present invention.

DETAILED DESCRIPTION OF THE INVENTION

Figure 1:
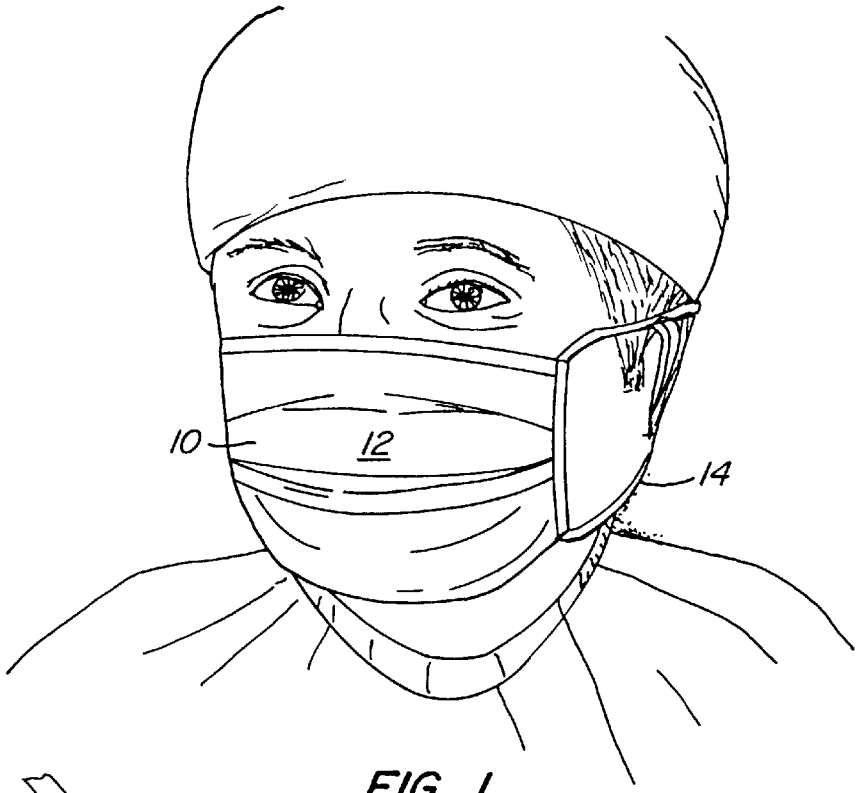
FIG. 1 shows a doctor wearing a surgical mask of the present invention.
Figure 2:
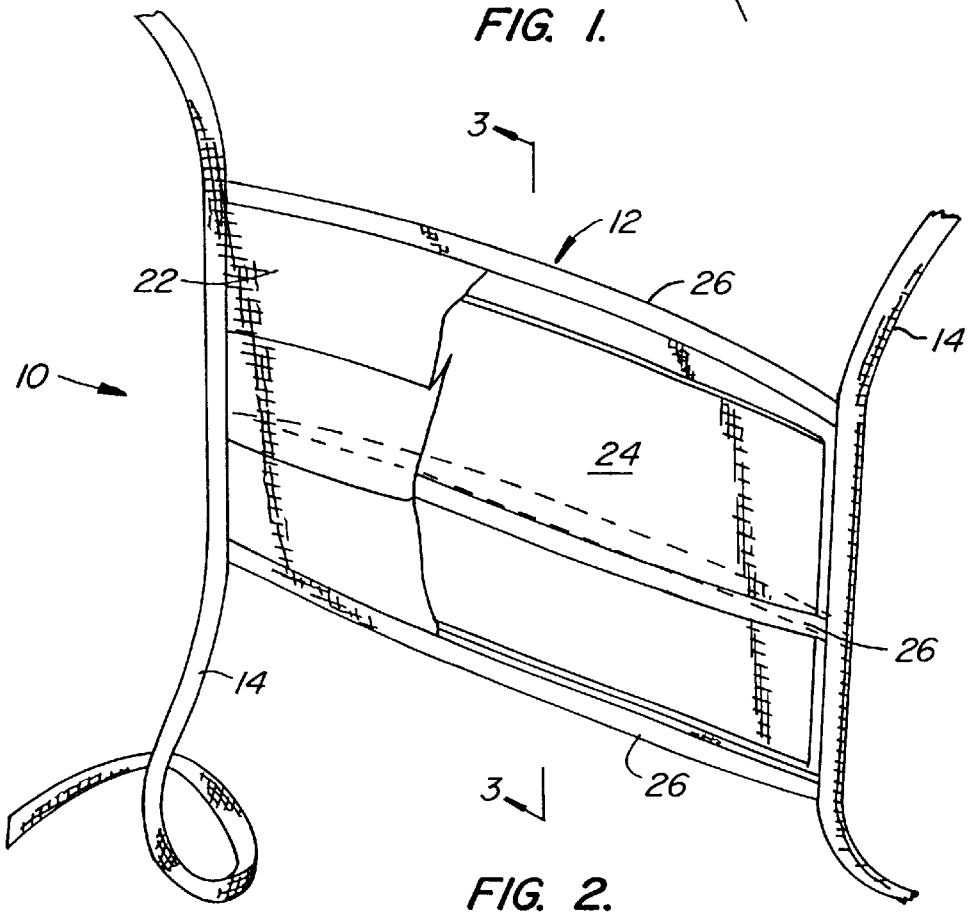
FIG. 2 shows a cutaway, perspective view of the surgical mask from FIG. 1.
Figure 3:
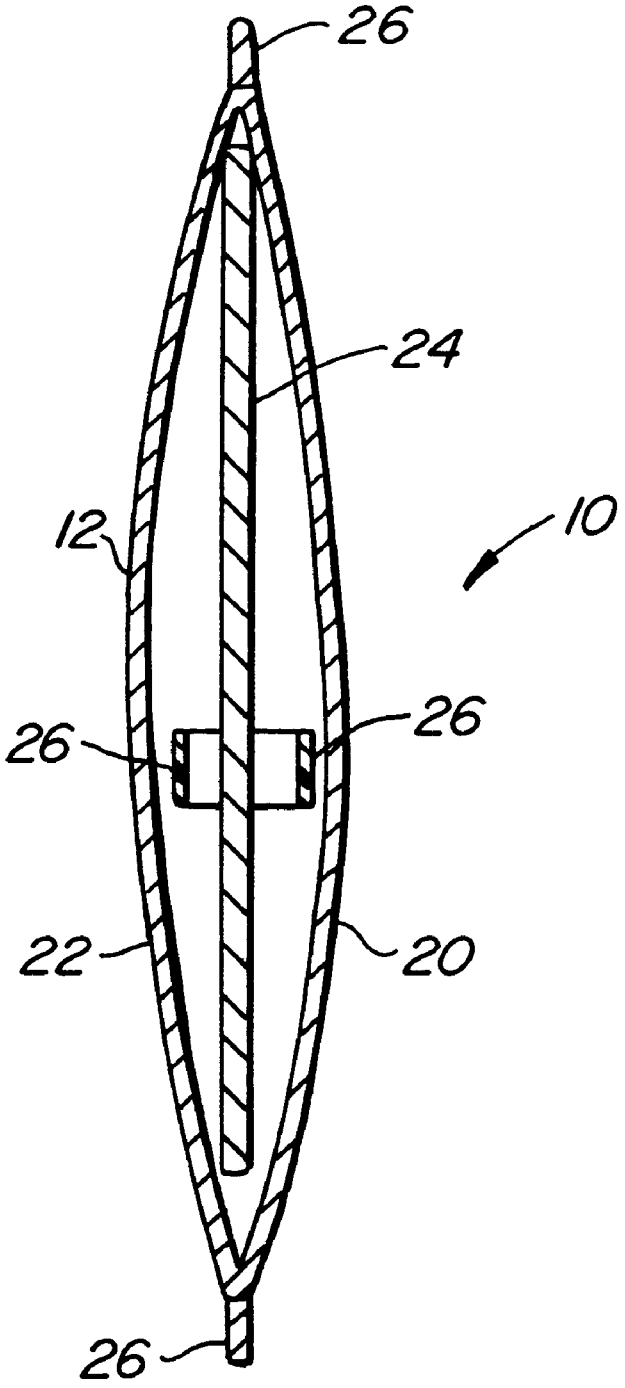
FIG. 3 shows a cross-sectional view of the surgical mask from FIGS. 1 and 2.

FIG. 1 shows a surgeon wearing a surgical mask 10 of the present invention. The surgical mask 10 has a facial portion 12 which covers the surgeon's mouth and nose as well as straps 14 which holds the surgical mask 10 onto the surgeon's face. As shown in FIGS. 2 and 3, the facial portion 12 of the surgical mask is primarily made up of three plies: an interior ply 20 situated next to the surgeon's face, an exterior ply 22 situated on the outside of the mask and a central liner 24. In its common, disposable form, the interior 20 and exterior 22 plies of the surgical mask 10 are made of paper and the central liner 24 is made of a breathable cloth material, such as gauze. Plastic or metal stays 26 are typically provided at the top, bottom and middle of the surgical mask 10 to help the surgical mask 10 retain its shape and enhance its seal.

As described thus far, the surgical mask 10 shown in FIGS. 1–3 is of conventional construction. A distinguishing aspect of the present invention is inexpensively imparting radiopaque qualities to such a surgical mask 10 without significantly diminishing its lightweight usability.

These radiopaque qualities can be imparted in a number of ways. In one preferred embodiment, the surgical mask of the present invention can be given radiopaque qualities by, prior to assembly, soaking or dipping its liner 24 in a high concentration solution of a lightweight radiopaque compound, such as barium sulfate, or the reagents used to form the lightweight radiopaque compound, such as barium chloride and sulfuric acid reagents to form a barium sulfate lightweight radiopaque compound. In the case of barium sulfate, this solution might advantageously be a 1 or 2 molar aqueous solution of barium sulfate precipitate (although other concentrations would also work). After the barium sulfate precipitate has been given an opportunity to thoroughly impregnate the liner 24 (e.g., by soaking overnight), the liner 24 can be removed from the barium sulfate solution and air dried. Drying can also be accomplished through use of a drying lamp or a microwave assembly. The impregnated liner 24 can then be placed between interior 20 and exterior 22 plies and sewn or sealed into the surgical mask 10 in a manner that is well known in the art. Since barium sulfate is capable of blocking x-rays, the impregnation of barium sulfate into a surgical mask liner 24 gives an otherwise conventionally constructed surgical mask 10 the ability to block x-rays from harming the surgeon's face while still allowing breathability.

To improve the efficiency of the impregnation process, various additives can advantageously be used. These additives include adhesives, fixatives and/or emulsifiers which can enhance the adhesion and/or thicken the solution of the lightweight radiopaque compound. For example, an adhesive, such as Gum Arabic or Guar Gum, might be added to the previously mentioned barium sulfate solution to both thicken the solution and increase the adhesion of barium sulfate to the mask material. Alternatively, the adhesive might be added to the mask material, rather than the barium sulfate solution. The pre-treated mask material would then be soaked or dipped in the barium sulfate solution.

In addition to being soaked or dipped in a premade solution containing lightweight radiopaque compounds, the lightweight radiopaque compounds of the present invention can also be impregnated into the liner 24 of a surgical mask 10 using alternative techniques. Where the radiopaque compound is in particulate form in solution (e.g., as a precipitate), one alternative technique is to choose a liner with pores that are smaller in size than the particles of radiopaque compound but larger in size than the solvent (e.g., water or alcohol) used for the radiopaque compound solution. The radiopaque compound solution can then be passed through the surgical mask liner 24 in a manner where the liner will act as a filter to filter out the radiopaque compound particles while allowing the solvent to pass through. In the case of an aqueous solution containing barium sulfate precipitate, the filter pore size should be on the order of 2 microns and correspond to Whatman's pore size 5. Similarly, the solution of radiopaque compound particles can be sprayed onto the liner. Again, after the liner 24 has been sufficiently impregnated with the radiopaque compound, it can then be dried and assembled into a surgical mask in the conventional manner.

In an second alternative embodiment, a reaction chamber can be created with a solution of one reagent used to create the radiopaque compound on one side, a solution of the complementary reagent used to create the radiopaque compound on the other side and a liner 24 placed in the middle. In the case of a barium sulfate radiopaque compound, these reagents might be barium chloride and sulfuric acid. In this barium sulfate example, because of the natural attraction of barium chloride to sulfuric acid, a chemical reaction will occur within liner 24 between the barium chloride and sulfuric acid which will leave behind a barium sulfate precipitate in liner 24.

In a third alternative, the liner 24 can be formed with one reagent incorporated within the liner 24 (e.g., as either a compound or free radical) and then exposed to the other reagent in order to create a resulting radiopaque impregnation. Again, in the case of a barium sulfate radiopaque compound, the liner 24 might advantageously be formed with barium or sulfate as part of the liner 24 and then exposed to the other compound in order to create the barium sulfate impregnation.

Barium sulfate is a preferred radiopaque precipitate for the present invention because, as compared with lead for example, it is lighter in weight, inexpensive, promotes breathability and has fewer known heath hazards. Other lightweight radiopaque compounds can also used to impregnate fabric for the present invention in a manner similar to that already described. These other lightweight radiopaque compounds include but are not limited to, HYPAQUE™, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium. These radiopaque compounds for the present invention can be purchased from a variety of chemical supply companies such as Fisher Scientific, P.O. Box 4829, Norcross, Ga. 30091 (Telephone: 1-800-766-7000), Aldrich Chemical Company, P.O. Box 2060, Milwaukee, Wis. (Telephone: 1-800-558-9160) and Sigma, P.O. Box 14508, St. Louis, Mo. 63178 (Telephone: 1-800-325-3010).

While the radiopaque impregnation examples provided thus far have been for a surgical mask liner 24, those of skill in the art will recognize that the principles of this invention can also be applied to a wide range of other applications. For example, rather than just the liner 24, the entire surgical mask 10 could be impregnated with a radiopaque compound of the present invention (e.g., barium sulfate or HYPAQUE™) in the manner previously described. It should be noted that this is a less preferred embodiment because the side of the surgical mask which comes in contact with the user's face should preferably be left untreated. Besides surgical masks, any number of other garments such as hoods, gowns, gloves, patient drapes, coverings, booties etc. could be given radiopaque qualities in the manner previously described.

Thus far, techniques have been described for imparting radiopaque qualities into a garment through impregnation with lightweight chemical compounds. In another alternative embodiment, sheets of radiopaque materials, such a aluminum, can be inserted between the plies of a garment to impart radiopaque qualities. For example, liner 24 of surgical mask 10 could be a sheet of aluminum foil. To provide breathability, this sheet of aluminum foil could be fenestrated or punctured with multiple holes (not shown). Breathability and protection can also be provided by staggering partial layers of radiopaque sheets with layers of porous cloth liners or staggering fenestrated radiopaque sheets. In the same vein, the radiopaque material, such as aluminum, could be formed into threads and woven into a garment or interwoven with a conventional garment material, such a cloth, to provide both the flexibility of a cloth garment and the x-ray protection of metallic garment. The radiopaque material could also be added to a variety of plastics, polymers or glass to create, for example, a clear eye shield with radiopaque qualities.

In the foregoing specification, the invention has been described with reference to specific preferred embodiments and methods. It will, however, be evident to those of skill in the art that various modifications and changes may be made without departing from the broader spirit and scope of the invention as set forth in the appended claims. For example, the preferred embodiments previously described have been in the field of medicine. Nonetheless, those of skill in the art know that radiation problems occur in many other fields, such as nuclear and electrical power, aviation and the military. For example, the amount of radiation a passenger is exposed to in a cross-country airplane flight is actually greater than the radiation exposure of a chest x-ray. As such, those of skill in the art will readily understand that the principles and techniques described in this application are applicable to any field where radiation is present. Also, the present invention can be used to impart radiation protection to fabrics or non-fabrics (e.g. plastics) currently in use in any of those fields. The specification and drawings are, accordingly, to be regarded in an illustrative, rather than restrictive sense; the invention being limited only by the appended claims.

What is claimed is:

1. A breathable, radiation protective material impregnated with a lightweight radiopaque compound selected from the group consisting of barium sulfate, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

2. A breathable, radiation protective paper garment comprising paper impregnated with a lightweight radiopaque compound and an additive.

3. The garment of claim 2 wherein said additive is an adhesive.

4. The garment of claim 2 wherein said additive is a fixative.

5. The garment of claim 2 wherein said additive is an emulsifier.

6. The garment of claim 2 wherein said lightweight radiopaque compound is selected from the group consisting of barium sulfate, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

7. A breathable, radiation protective paper garment comprising paper impregnated with both a lightweight radiation protective compound consisting essentially of barium sulfate and an adhesive additive.

8. The garment of claim 7 wherein said garment is a surgical mask.

9. The garment of claim 7 wherein said garment is a patient drape.

10. The garment of claim 7 wherein said adhesive additive is Gum Arabic.

11. The garment of claim 7 wherein said adhesive additive is Guar Gum.

12. A breathable, surgical mask with radiopaque qualities comprising a facial portion impregnated with both a lightweight radiopaque compound and an adhesive additive, and a plurality of straps connected to said facial portion.

13. The surgical mask of claim 12 wherein said lightweight radiopaque a compound is selected from the group consisting of barium sulfate, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

14. The surgical mask of claim 12 wherein said facial portion further comprises a paper liner interposed between two paper plies wherein only said paper liner is impregnated with said adhesive additive and a lightweight radiopaque compound consisting essentially of barium sulfate.

15. A breathable, surgical mask with radiopaque qualities comprising a facial portion having a paper liner interposed between two paper plies and a plurality of straps connected to said facial portion wherein said liner is impregnated with a lightweight radiopaque compound consisting essentially of barium sulfate and adhesive additive.

16. The breathable, surgical mask of claim 15 wherein said adhesive additive is Gum Arabic.

17. The breathable, surgical mask of claim 15 wherein said adhesive additive is Guar Gum.

18. A method for creating a breathable garment with radiopaque qualities comprising the steps of:

soaking breathable fabric in a solution of a lightweight radiopaque compound with an adhesive additive in order to impregnate said fabric, drying said lightweight radiopaque compound impregnated fabric, and using said impregnated fabric to construct said garment.

19. The method of claim 18 wherein said lightweight radiopaque compound is selected from the group consisting of barium sulfate, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

20. The method of claim 18 wherein said adhesive additive is Gum Arabic.

21. The method of claim 18 wherein said adhesive additive is Guar Gum.

22. A method for creating a breathable garment with radiopaque qualities comprising the steps of:

selecting a lightweight radiopaque compound which is particulate in solution and placing said lightweight radiopaque compound in a solution with an adhesive additive, selecting a fabric with pores smaller than the lightweight radiopaque compound particles and pores larger than the solvent, passing a solution containing the radiopaque compound particles through said fabric until said fabric is impregnated with radiopaque compound particles, drying said impregnated fabric, and using said impregnated fabric to construct said breathable garment.

23. The method of claim 22 wherein said lightweight radiopaque compound is selected from the group consisting of barium sulfate, Diatrizoate Meglumine Inj USP, Acetrizoate Sodium, Bunamiodyl Sodium, Diatrizoate Sodium, Ethiodized Oil, Iobenzamic Acid, Iocarmic Acid, Iocetamic Acid, Iodipamide, Iodixanol, Iodized Oil, Iodoalphionic Acid, o-Iodohippurate Sodium, Iodophthalein Sodium, Iodopyracet, Ioglycamic Acid, Iohexol, Iomeglamic Acid, Iopamidol, Iopanoic Acid, Iopentol, Iophendylate, Iophenoxic Acid, Iopromide, Iopronic Acid, Iopydol, Iopydone, Iothalamic Acid, Iotrolan, Ioversol, Ioxaglic Acid, Ioxilan, Ipodate, Meglumine Acetrizoate, Meglumine Ditrizoate Methiodal Sodium, Metrizamide, Metrizoic Acid, Phenobutiodil, Phentetiothalein Sodium, Propryliodone, Sodium Iodomethamate, Sozoiodolic Acid, Thorium Oxide and Trypanoate Sodium.

* * * * *